United States Patent [19]

Kovacs et al.

[11] Patent Number: 5,064,478

[45] Date of Patent: Nov. 12, 1991

[54] METHOD AND APPARATUS FOR SURFACE AUSTEMPERING OF CAST IRON PARTS

[75] Inventors: Bela V. Kovacs, Bloomfield Hills; John R. Keough, Birmingham; Douglas M. Pramstaller, Highland, all of Mich.

[73] Assignee: Applied Process, Livonia, Mich.

[21] Appl. No.: 444,994

[22] Filed: Dec. 4, 1989

[51] Int. Cl.[5] ..... C21D 8/04

[52] U.S. Cl. ..... 148/12.4; 148/321; 148/15.5; 148/141; 148/144; 420/902

[58] Field of Search ..... 148/15, 15.5, 18, 20, 148/20.6, 141, 144, 321; 420/902

[56] References Cited

U.S. PATENT DOCUMENTS 4,596,606 6/1986 Kovacs et al. ..... 148/321

OTHER PUBLICATIONS

W. Paul Eddy, Jr., "Liquid Baths for Heat Treating-Oil and Lead", The Iron Age, Sep. 1, 1932, pp. 323, 20.

W. Paul Eddy, Jr., "Liquid Baths for Heat Treating—Low Temperature Salt Baths", The Iron Age, Oct. 20, 1932, p. 613.

*Primary Examiner*—H. Dean

*Assistant Examiner*—Sikyin Ip

*Attorney, Agent, or Firm*—Lynn E. Cargill

[57] ABSTRACT

A method for producing a selectively surface hardened cast iron part includes uniformly heating the surface of the part by immersion into a molten metallic bath until a desired thickness of surface austenite is produced, and thereafter quenching the heated cast iron part in a liquid quenching bath which is maintained at a temperature of between about 450° to about 800° F. for about 10 minutes to about 4 hours. The resultant selectively surface hardened cast iron part is surface hardened with the bulk of the body of the part remaining untempered. An apparatus for performing this process includes a molten metal bath chamber for containing the molten metal and a molten salt bath quenching chamber for quenching the cast iron parts with a conveyor means extending between the molten metal bath and the molten salt bath chambers. A second conveyor means removes the parts from the molten salt bath chamber.

24 Claims, 1 Drawing Sheet

1/1
FIG 1
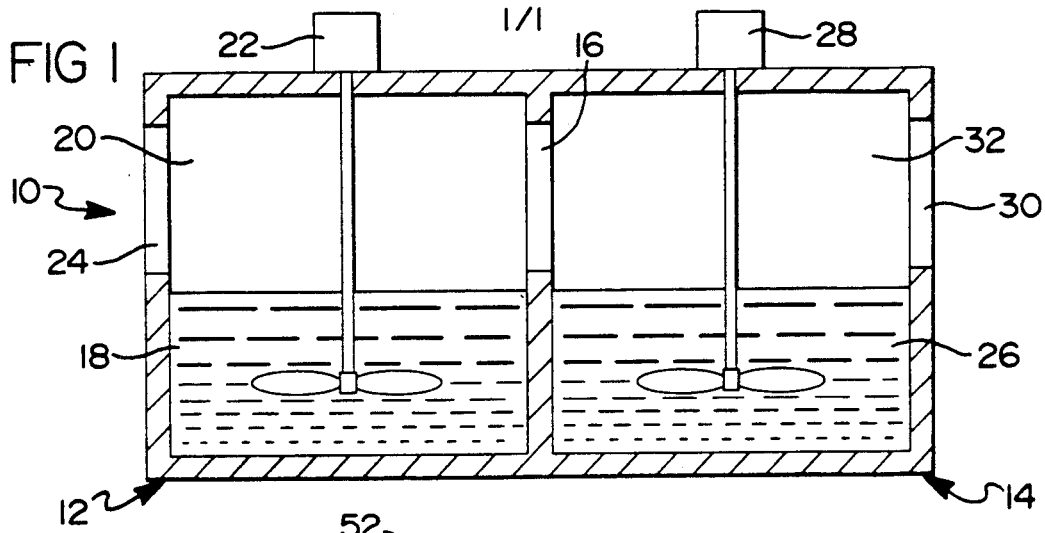
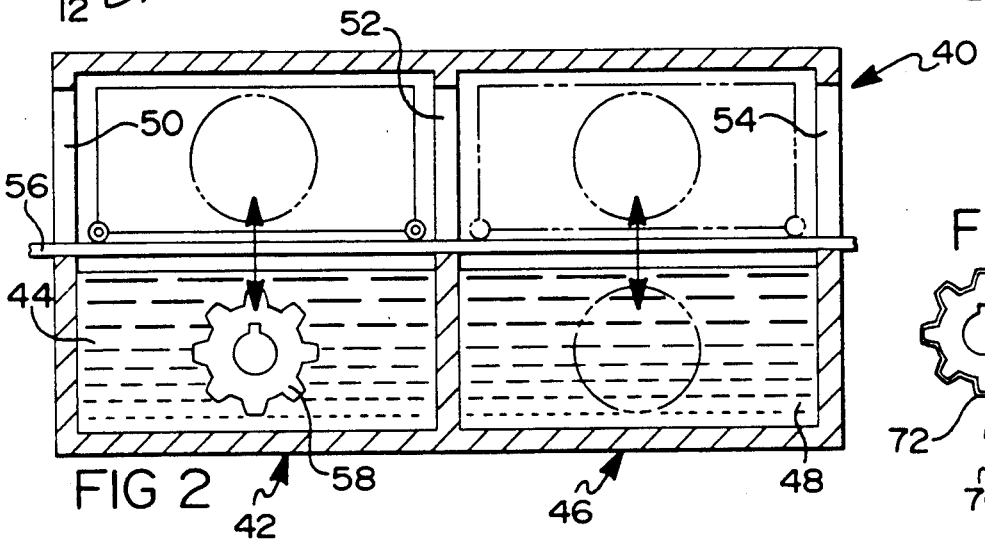
FIG 2
FIG 3
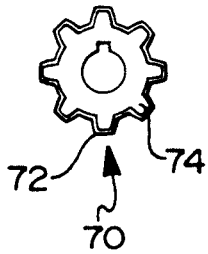
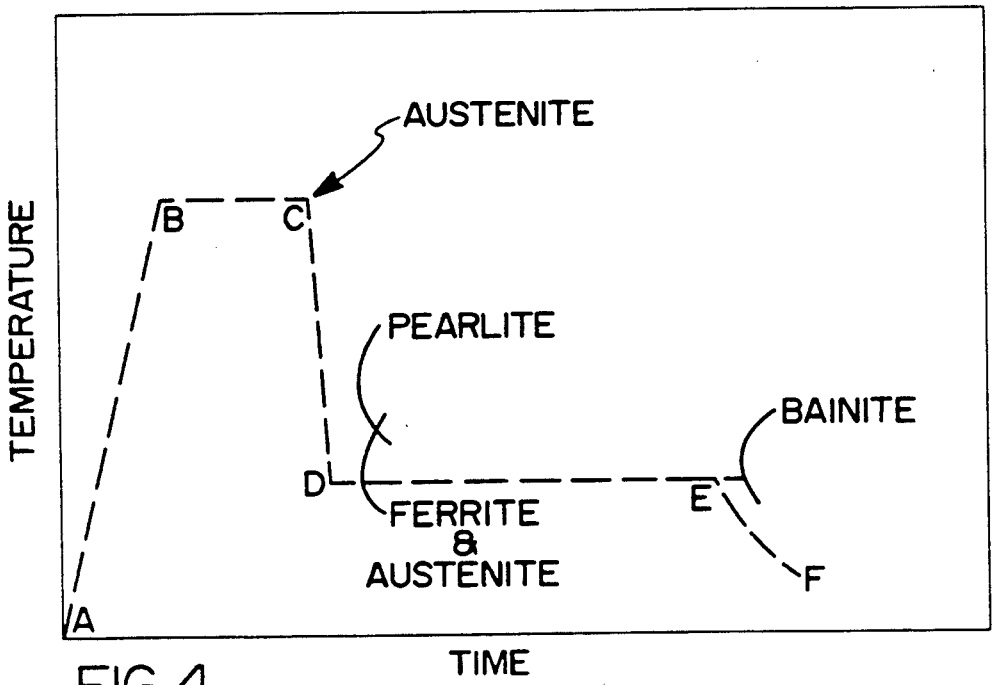
FIG 4

METHOD AND APPARATUS FOR SURFACE AUSTEMPERING OF CAST IRON PARTS

TECHNICAL FIELD

This invention relates generally to surface hardening of cast parts, and more particularly to surface austempering of cast iron parts.

BACKGROUND OF THE INVENTION

Traditionally, cast iron parts are cast into a desired shape, and then machined until proper tolerances are met. Some of these cast parts require hardening or tempering in order to prolong the lifetime of the part. In the past, the entire part may have been tempered by fully tempering or by through tempering to add wear resistance. For the manufacturer of parts, these wear enhancing methods are disadvantageous because they distort the shape of the part and make machining very difficult. Tempering a part includes heating the part to an austentizing temperature, and then quenching to cause compressive stresses to the material which hardens the part surface to add to its wearability. This has been very expensive due to high cycle times, high energy consumption, and the formation of low quality parts due to sagging during the heating stages.

Consequently, some historical attempts have been made to harden merely the surface of the part while allowing the cast core to remain untransformed. Flame hardening and induction have been used to locally heat the area before quenching to achieve surface hardening. These methods are limited in that they are not useful for cast parts which have many protrusions and indentations because flame hardening and induction methods cannot uniformly and perpendicularly heat all the surfaces at the same time. Manufacturers utilizing the surfaces at the same time. Manufacturers utilizing these methods have experienced problems due to uneven heating, non-homogeneous brittleness and low yield production. Furthermore, the surface hardened parts produced by such prior art methods are inherently expensive and difficult to manufacture and machine.

Conventional surface hardened methods are limited in that they are not useful for preparing mechanical parts which do not exhibit any distortion during heat treatment in order to provide the surface hardening. The previous methods have been unable to produce such articles at a low cost because their methods do not include the isopressure advantage which can conveniently, quickly and uniformly surface harden an entire mechanical part.

Previously, surface hardening was done by remelting the surface by irradiating a high density energy, for example, a TIG arc, and thereafter forming a continuous chill layer by self cooling. Other methods include pouring molten metal into a mold having a chill set therein, forming carbide in contact with the chill. Other methods have included inductively heating a preheated part to an austenizing temperature which was followed by quenching an isothermal transformation. The TIG torches mentioned above only cover a very small localized area, and it would be very advantageous to provide a method for uniformly and selectively surface hardening an entire part. TIG torches, or TIG arcs, only selectively heat a very small portion on the order of several millimeters in diameter. Consequently, in order to do a complete part such as a cam or gear surfaces, the prior art processes have been very labor and time intensive.

Yet still some other prior art methods for selectively hardening parts have included a strip hardening process and a combination induction heating through selectively austenizing a surface zone and thereafter quenching to cause a selectively higher dilatation in the surface zone. These methods also result in very small area surface hardening. And yet one more method for selectively surface hardening in the prior art includes an electron bombardment metal melting process which forms molten pools on the surface, followed by rapidly cooling the molten pool by the chilling effect of the non-molten portion of the cast iron part. Attempts to produce cast iron parts having surface hardening over the entire surface have met with failure because these prior art methods have all been limited to the local surface areas which are covered by the surface hardening technique.

Examples of previous attempts to increase production while preparing a cast iron part having a hardened surface are described in the following patents:

U.S. Pat. No. 4,720,321 issued to Toyota on Jan. 19, 1988 discloses a process for producing surface remelted chilled layer cam shafts. The method includes the step of melting a sliding cam surface by subjecting to high density energy through a TIG arc and thereafter forming a chilled layer by self cooling.

U.S. Pat. No. 4,772,340 issued to Honda Motor Company on Sep. 20, 1988 discloses a method of making iron-based articles having a remelted layer which is formed by pouring molten metal into a mold which has a chill set therein to cast iron based articles with chilled regions formed that have come into contact with the chilled set.

U.S. Pat. No. 4,312,685 issued to Audi Motor Company on Jan. 26, 1982 discloses a surface hardening method for cams of motor vehicle cam shafts. The cam has its surface hardened by rotating the cam shaft about its axis while maintaining a TIG torch at a fixed spacing from the surface, and while relatively axially reciprocating the torch and the cam shaft so that the torch heats the surface at an undulating path. After removing the TIG torch, the remelted layer then chills to provide a surface hardened area.

U.S. Pat. No. 4,643,079 issued to General Motors Corporation on Feb. 17, 1987 discloses an iron piston having selectively hardened ring grooves. In the preferred embodiment, the groove faces were hardened by a strip hardening process.

U.S. Pat. No. 3,477,884 issued to Schlicht, et al. on Nov. 11, 1969 discloses a method of increasing the fatigue life of rolling contact elements which is accomplished by a combination of induction heating to selectively austenitize a surface zone adjacent the rolling contact surface, quenching to cause a selectively higher dilatation in the surface zone, and inducting tempering of the quenched element so as to produce in the surface zone a volume contraction which provides a residual compressive stress on the surface.

U.S. Pat. No. 4,000,011 issued to Sato et al. on Dec. 28, 1976 discloses a method of surface hardening which includes the steps of rapidly melting a local surface by means of an electron bombardment melting process to form a molten pool thereon. Thereafter, the molten pool is rapidly cooled by the chilling effect of the non-molten portion of the cast iron. The cast iron part having the hardened layer is finally finished to form a desired shape.

Therefore, it is a primary object of the present invention to provide a selective surface hardening method in accordance with the present invention which will produce cast iron parts which may be easily, inexpensively, and uniformly surface hardened over the entire surface of the cast iron part.

It is another object of the present invention to provide a method which will yield cast iron parts which may be pre-finish-machined before the surface hardening step of the method is accomplished. Thereby, cast iron parts may be placed in their final form and machined while the surface is easy to machine, and may then be selectively surface hardened thereafter without having to do substantial finish machining on a hardened part.

It is yet another object of the present invention to provide a method which will produce a selectively surface hardened cast iron part which may be machined before surface hardening while not producing any substantial size distortion after the finish machining has been accomplished.

SUMMARY OF THE INVENTION

In accordance with a preferred embodiment of the present invention, these and other objects and advantages are addressed as follows. A selectively surface hardening method capable of producing a surface hardened piece which has previously been finish machined is disclosed. The method is capable of producing cast iron parts with selective surface hardening without heating the entire bulk of the part, thereby avoiding size distortion, such as sagging or thermal expansion and contraction non-hysterisis effects. The cycle time will be lowered, and the cost will also be lowered because natural gas may be used to heat the molten metallic bath.

The basic method for producing a selectively surface hardened cast iron part includes uniformly heating the surface of the cast iron part by immersing it in a molten metallic bath, such as lead or tin, which is maintained at a temperature of from about 1500 to about 1800 degrees F. for a desired time until a desired thickness of surface austenite is produced. The molten metal perpendicularly heats all surfaces as opposed to the prior art methods of induction or flame which heats the tips of projections sticking out from the cast parts. The heated cast iron part is then quenched in a liquid quenching bath, such as molten salt or hot oil which is maintained at a temperature of from about 450 to about 800 degrees F. for about 10 minutes to about 4 hours to produce a selectively surface hardened cast iron part. The above described method appears to be particularly useful for cast iron parts made from compacted graphite iron, gray iron, malleable iron, or ductile iron.

In another embodiment of the present invention, the method may also include uniformly heating the surface of a finished-machine cast iron part by immersing it in a molten lead bath maintained at a temperature from about 1500–1800 degrees F. for about 30 to about 120 seconds, while maintaining an inert atmosphere above the molten lead bath. Due to the density of the lead bath, there is no sagging of the part as the part experiences zero gravity because it is floating. The inert atmosphere is maintained above the lead bath in order to minimize the surface reactions which may contaminate the cast iron part while it is in its heated stage. Thereafter, the heated cast iron part may be quenched in a molten salt bath of about 50 percent potassium nitrate and about 50 percent sodium nitrite which is kept at from 450–750 degrees F. for about ½ hour to 4 hours. The inert atmosphere may include nitrogen, argon, or helium, or any mixture thereof over the molten bath.

Immersion of the cast iron part into the molten metal bath will form a certain thickness of surface austenite on the part. Depending upon the ultimate wear resistance desired for the parts, the surface austenite thickness is from about 1/30 inch to about ¼ inch. This is especially useful for parts which merely require wear resistance on the surface and do not need strength throughout the part.

The above mentioned have been found to be useful with cast iron parts made by sand casting, permanent mold casting, or ceramic mold casting. By this method, parts may be produced which may be finish machined before they are immersed in the molten metallic bath, and they are dipped for such a short period of time that the body of the part will not change temperature significantly, and therefore no size distortion will take place.

Further disclosed is a selectively surface hardened cast iron part produced by the above described methods. In addition, an apparatus for selectively surface hardening the cast iron parts is also recited which includes a molten metal bath chamber for holding the molten metal bath, a molten salt bath quenching chamber for quenching the cast iron parts which are received from the molten metal bath, and a conveyor means extending between the two bath chambers for moving parts from one end to the other.

Due to the thinner austenite layer formed on the surface of the part, the quench rate is much higher, resulting in finer grains, i.e. better wear resistance, the ultimate goal for any hardened part. Consequently, parts treated by the method and apparatus of the present invention exhibit many advantages over prior art parts.

BRIEF DESCRIPTION OF THE DRAWINGS

The nature and extent of the present invention will be clear from the following detailed description of the particular embodiments thereof, taken in conjunction with the appendant drawings, in which:

FIG. 1 shows a cross-sectional view of the surface hardening device constructed in accordance with the present invention, wherein a molten metallic bath is adjacent to a molten salt quenching chamber, and further shows agitation means for swirling the molten solutions around the cast iron part to ensure uniformity;

FIG. 2 illustrates a cross-sectional side view of another embodiment of the inventive device wherein a conveyor means is accommodated between the molten metallic bath and the molten salt bath;

FIG. 3 is a cross-sectional part of a selectively surface hardened cast iron gear part; and FIG. 4 is a graph of the temperature differential and austenitic reactions shown as temperature versus time.

DETAILED DESCRIPTION OF THE INVENTION

Referring first to FIG. 1, there is shown a cross sectional view of a surface hardening apparatus generally denoted by the numeral 10. Surface hardening apparatus 10 is divided generally into two chambers, a molten metal bath chamber 12 and a liquid quenching chamber 14, with passageway 16 between the chambers. Molten metal bath chamber 12 contains molten metal bath 18 consisting of, e.g., molten lead or tin with an inert atmosphere 20 above molten metal bath 18 which may include nitrogen, argon, helium, or mixtures thereof or may simply have no gas present (i.e. under vacuum). The inert atmosphere minimizes oxidation reactions from occurring in the metallic bath thereby maintaining the bath's purity. Molten metal bath chamber 12 is equipped with agitating means 22 which may consist of propellers supported by a shaft which is rotated by a motor as depicted. Molten metal bath chamber 12 also has closable opening 24 to outside apparatus 10 to provide a place for inserting a cast iron part therein to be surface hardened.

To keep oxidizing atmospheres from entering the molten metal bath chamber, any openings to the outside are usually kept closed. Preferably, to maintain the inert atmosphere over the molten metal bath chamber, the molten metal bath chamber has a conventional holding chamber attached at the opening to the outside. The holding chamber (not shown) would have two closable openings, one to the outside and one to the molten metal bath chamber. One of ordinary skill in the art would be well versed in such conventional arrangements.

When a cast iron part is to be placed within the surface hardening apparatus, the part would be first placed in the holding chamber, then all openings of the holding chamber would be closed, and the air evacuated from the holding chamber. Once air has been evacuated from the holding chamber, the opening between the holding chamber and the molten metal bath chamber may be opened to allow passage of the part from the holding chamber to the molten metal bath chamber. With the use of such a holding chamber, little or no oxidizing or contaminating gases would enter the molten metal bath chamber, thereby minimizing oxidation reactions within the molten metal.

The cast iron part is then immersed in molten metal bath 18 which is maintained at a temperature of from about 1500 to about 1800° F. and the part is retained in the agitating molten metal bath until a desired thickness of surface austenite is produced. In a preferred embodiment, the molten metal in the bath is lead or tin. Molten lead exhibits two specific advantages: (1) due to its greater density than the cast iron part, the lead tends to buoy the part which evenly applied pressure over the entire part, thereby more uniformly and perpendicularly heating all the surfaces of the part no matter how convulated they may be; and (2) the molten lead does not stick to the part when it is removed from the bath, so that the part comes out of the bath in a very clean condition.

Thereafter, the cast iron part is quickly transferred to liquid quenching bath 26 in liquid quenching bath chamber 14. Liquid quenching bath 26 may consist of hot oil or molten salts, e.g. potassium nitrate, sodium nitrite, and mixtures thereof. Preferably, a 50:50 mixture of molten potassium nitrate and sodium nitrite is used. Liquid quenching bath chamber 14 is equipped with agitating means 28 to agitate the liquid while the cast iron part is immersed for more efficient heat exchanging. Liquid quenching bath chamber 14 also has an opening 30 leading to the outside for removal of the treated parts. Preferably, opening 30 is closable, similar to opening 20 discussed above. Atmosphere 32 above liquid quenching bath 26 may be the same as atmosphere 20 above molten metal bath 18. This is especially useful when the opening between the molten metal bath chamber and the liquid quenching chamber is left open. Alternatively, in the event that there may be a gate between the molten metallic and salt baths, atmosphere 32 may be essentially any gas, as oxidation and other contaminating reactions are not as much a concern for liquid quenching bath 26.

Moving now to FIG. 2, surface hardening apparatus 40 is shown in cross section, and consists generally of molten metal bath chamber 42 containing molten metal bath 44 and liquid quenching chamber 46 containing liquid quenching bath 48. Similar to apparatus 10 of FIG. 1, apparatus 40 has an opening 50 leading from outside the apparatus to inside the molten metal bath chamber 42. Opening 52 extends between the two chambers, and opening 54 extends between the liquid quenching bath chamber 46 and the outside. Apparatus 40 is equipped with conveyor means 56 which is capable of transporting cast iron part 58 from outside apparatus 40 to inside molten metal bath chamber 42, onward to liquid quenching bath chamber 46, and then out of apparatus 40. Conveyor means 56 may be of any conventional design which can move parts from one station to another. Again, one of ordinary skill in the art would be able to construct such a conveyor means without undue experimentation.

FIG. 3 depicts and illustrates a cross sectional view of a surface hardened cast iron part 70, such as a gear, of this invention having selectively hardened surface layer 72 and unhardened core 74. As shown, the surface hardened portion 72 of the cast iron part is substantially uniformly distributed about the core 74 of part 70. This is especially helpful because uniform wear resistance is achieved, unlike the localized surface hardened parts produced by the prior art. Because the molten metal surrounds the part when it is dipped in, substantially all of the surfaces of parts having a convoluted shape come into contact with the heating medium (the molten metal). In prior art methods utilizing torches, and other localized heating, the heating could not occur perpendicularly to all surfaces. These prior art methods would not be as desirable due to their inability to uniformly heat all surfaces perpendicularly to ready the part for hardening.

The cast iron part 70 may be a finish-machined iron part made of compacted graphite iron, gray iron, malleable iron, or ductile iron. The parts may be made by sand casting, permanent mold casting or ceramic mold casting. Depending upon the ultimate use of the part and the desired thickness of the hardened surface, the part is immersed in the molten metallic bath for a time period of between 10 seconds and 5 minutes. About 45 seconds is useful for gears and cams. Lead or tin may be used as the molten metal in the bath used to treat these parts. Neither of these metals appear to stick to the part, and they are denser than the part, so the part experiences somewhat of a floating, which also helps in the uniform heating of the outside layer. The outside layer of surface austenite formed during the immersion step may be of a thickness from about 1/32 to about ¼ inch. Therefore, upon quenching, the hardened surface layer will be nearly of that dimension.

FIG. 4 depicts the time-temperature curve that a cast iron part experiences during the method of this invention. Initially, the surface of the cast iron part is uniformly heated by immersing the part in a molten metallic bath which is maintained at a temperature of from about 1500 to about 1800° F. for about 10 seconds to about 5 minutes until a desired thickness of surface austenite is produced. In FIG. 4, the portion of the curve between point A and point B represent the heating up after dipping the part in the molten metal. The line segment B-C of the curve occurs at the temperature between 1500 to 1800° F. depending upon the molten metal used, forming the surface austenite. Line segments C-D of FIG. 4 represent the quenching of the heated cast iron parts in the liquid quenching bath which is maintained at a temperature of between about 450 to about 800° F. Line segment D-E refers to the maintenance within the quenching bath of the cast iron parts at a temperature of between about 450 to about 800° F. for from about 10 minutes to about 4 hours. Arc curve E-F segment of FIG. 4 takes place as the part is returned to room temperature. Depending upon the chemical composition and stoichiometry of the particular cast iron composition of the cast iron part, the molten metallic bath may be maintained at a temperature from about 1500 to about 1800° F. Preferably, the molten bath is either a lead or tin bath, and the quenching step is accomplished by quenching the heated parts in a bath of material which may be hot oil or a molten salt, wherein the salt may be made of a composition of between about 0 to 50% by volume potassium nitrate and 50 to 100% by volume sodium nitrite, or a 50/50 combination of both. The part is then cooled to room temperature before the bainitic reaction takes place.

While my invention has been described in terms of a specific embodiment, it must be appreciated that other embodiments could readily be adapted by one skilled in the art. Accordingly, the scope of my invention is to be limited only by the following claims.

What is claimed is:

1. A method for producing a selectively surface hardened cast iron part, comprising:

uniformly heating the surface of the cast iron part, without heating the interior of the cast iron part, by immersing the part in a molten matallic bath maintained at a temperature of from about 1500 to about 1800 degrees Fahrenheit for about 10 second to about 5 minutes to form a desired thickness of surface austenite, wherein only the surface of the cast iron part is prepared for hardening;

quenching the surface heated cast iron part in a liquid quenching bath maintained at a temperature of between about 450 to about 800 degrees Fahrenheit for about 10 minutes to about 4 hours; and cooling the cast iron part before bainite is formed.

such that the interior bulk of the part remains substantially unheated and unhardened, and only the surface is hardened.

2. The method of claim 1, wherein said step of uniformly heating the surface of the cast iron part is accomplished by uniformly heating the surface of a finish-machined iron part made of a cast iron selected from the group consisting of compacted graphite iron, gray iron, malleable iron, and ductile iron.

3. The method of claim 1, further comprising an additional step of agitating the cast iron part after immersion in the molten metallic bath.

4. The method of claim 1, further comprising an additional step of agitating the molten metal around the part after immersing the part in a molten metallic bath.

5. The method of claim 1, wherein said step of heating the cast iron part by immersing the part in a molten metallic bath is accomplished by immersing the part in a metallic bath including a molten metal selected from the group consisting of lead and tin.

6. The method of claim 1, wherein said step of uniformly heating the cast ]-ron part until a desired thickness of surface austenite is produced includes producing a thickness of austenite from about 1/32 inch to about ¼ inch.

7. The method of claim 1, wherein said step of quenching the heated cast iron part in a liquid quenching bath is accomplished by quenching in a quenching bath including a quenching fluid selected from the group consisting of molten salt and hot oil.

8. The method of claim 1, wherein said quenching in a liquid quenching bath is accomplished by quenching in a molten salt bath including a molten salt selected from the group consisting of potassium nitrate, sodium nitrite, and mixtures thereof.

9. A method for producing a finish-machined, selectively surface hardened cast iron part, comprising:

uniformly heating the surface of a finish-machined cast iron part, without heating the interior of the cast iron part, by immersing in a molten lead bath maintained at a temperature from about 1500–1800 degrees Fahrenheit for about 30 to about 120 seconds, wherein only the surface of the cast iron part is prepared for hardening while maintaining an inert atmosphere above the molten lead bath;

quenching the surface heated cast iron part in a molten salt bath of about 50% potassium nitrate and about 50% sodium nitrite maintained at a temperature of from about 450 to about 750 degrees Fahrenheit for about ½ to about 4 hours; and cooling the cast iron part before bainite is formed, such that the interior bulk of the part remains substantially unheated and unhardened, and only the surface is hardened.

10. The method of claim 9, further comprising a step of agitating the cast iron part after immersion in the molten lead bath.

11. The method of claim 9, further comprising a step of agitating the molten lead around the part after immersion.

12. The method of claim 9, wherein the step of maintaining an inert atmosphere is accomplished by maintaining an atmosphere of gas selected from the group consisting of nitrogen, argon and helium over the molten lead bath.

13. The method of claim 9, wherein said step of uniformly heating the surface of the cast iron part is accomplished by uniformly heating the surface of an iron part made of an iron selected from the group consisting of compacted graphite iron, gray iron, malleable iron, and ductile iron.

14. A selectively surface hardened cast iron part, comprising:

a cast iron core formed by casting and finish machining into a desired shape;

a selectively hardened surface surrounding the cast iron core, said surface being formed by rapidly heating the surface of the cast iron part by immersing in a molten metallic bath maintained at a temperature of from about 1500 to about 1800 degrees Fahrenheit for about 5 minutes or less, to form a desired thickness of surface austenite, wherein only the surface of the cast iron part is prepared for hardening;

thereafter quenching by immersing the surface heated cast iron part in a quenching bath maintained at a bainite reaction temperature of between about 450 to about 800 degrees Fahrenheit for about 10 minutes to about 4 hours to produce the desired hardness and physical properties in the surface layer; and cooling the cast iron part before bainite is formed, such that the interior bulk of the part remains substantially unheated and unhardened, and only the surface is hardened.

15. The selectively surface hardened cast iron part of claim 14, wherein said cast iron core is formed of an iron selected from a group consisting of compacted graphite iron, gray iron, malleable iron and ductile iron.

16. The selectively surface hardened cast iron part of claim 14, wherein said cast iron part is formed by a method of casting selected from the group consisting of sand casting, permanent mold casting, and ceramic mold casting.

17. The selectively surface hardened cast iron part of claim 14, wherein said desired thickness of surface austenite is formed by immersing the cast iron part in the molten metallic bath for about 10 seconds to about 5 minutes.

18. The selectively surface hardened cast iron part of claim 17, wherein said desired thickness of surface austenite is formed by immersing the cast iron part in the molten metallic bath for about 45 seconds.

19. The selectively surface hardened cast iron part of claim 14, wherein said part is formed by immersing in a metal bath selected from the group consisting of lead and- tin.

20. The selectively surface hardened cast iron part of claim 14, wherein said molten metallic bath maintained at a temperature of from about 1500 to about 1800 degrees Fahrenheit depends o the chemical composition and stoichiometry of the particular cast iron composition of the cast iron part.

21. The selectively surface hardened cast iron part of claim 14, wherein said desired thickness of surface austenite includes a thickness of from about 1/32 inch to about ¼ inch.

22. The selectively surface hardened cast iron part of claim 14, wherein said part is quenched in a bath of a material selected from the group consisting of hot oil and molten salt.

23. The selectively surface hardened cast iron part of claim 22, wherein said quenching bath is made from a composition of between about 0 to 50 percent by volume potassium nitrate and 50 to 100 percent by volume sodium nitrite.

24. The selectively surface hardened cast iron part of claim 23, wherein said part is quenched in a quenching bath of about 50 percent potassium nitrate and about 50 percent sodium nitrite.

* * * * *